US010378704B2

(12) United States Patent
Adema et al.

(10) Patent No.: US 10,378,704 B2
(45) Date of Patent: Aug. 13, 2019

(54) LED MODULE SEAM ILLUMINATION

(71) Applicant: CHRISTIE DIGITAL SYSTEMS USA, INC., Cypress, CA (US)

(72) Inventors: Daniel Robert Adema, Kitchener (CA); Bryan Hemphill, Waterloo (CA); Marc Lemieux, Guelph (CA)

(73) Assignee: CHRISTIE DIGITAL SYSTEMS USA, INC., CA (US)

( * ) Notice: Subject to any disclaimer, the term of this patent is extended or adjusted under 35 U.S.C. 154(b) by 76 days.

(21) Appl. No.: 15/725,716

(22) Filed: Oct. 5, 2017

(65) Prior Publication Data

US 2019/0107260 A1 Apr. 11, 2019

(51) Int. Cl.

| | |
|---|---|
| ***G09G 3/325*** | (2016.01) |
| ***F21S 2/00*** | (2016.01) |
| ***F21K 9/20*** | (2016.01) |
| ***G09G 3/32*** | (2016.01) |
| ***H05B 33/08*** | (2006.01) |
| ***F21V 23/06*** | (2006.01) |

(52) U.S. Cl.

CPC ..... *F21S 2/005* (2013.01); *F21K 9/20* (2016.08); *F21V 23/06* (2013.01); *G09G 3/32* (2013.01); *H05B 33/0842* (2013.01); *H05B 33/0857* (2013.01)

(58) Field of Classification Search

None

See application file for complete search history.

(56) References Cited

U.S. PATENT DOCUMENTS

| | | | | |
|---|---|---|---|---|
| 8,189,135 | B2 | 5/2012 | Bae et al. | |
| 8,212,766 | B2 | 7/2012 | Lee et al. | |
| 8,342,731 | B2 | 1/2013 | Shimizu | |
| 2010/0123384 | A1 | 5/2010 | Miller et al. | |
| 2013/0176352 | A1* | 7/2013 | Watanabe | G09G 3/34 345/690 |
| 2015/0362657 | A1* | 12/2015 | Wang | G02B 6/0045 345/690 |

FOREIGN PATENT DOCUMENTS

| | | |
|---|---|---|
| CN | 202285170 U | 6/2012 |

* cited by examiner

*Primary Examiner* — Carl Adams

(74) *Attorney, Agent, or Firm* — Perry + Currier Inc.

(57) ABSTRACT

An LED display system having an LED module for reducing dark line defects. LED modules arranged adjacently in an LED display system form seams therebetween. An LED module for reducing dark line defects includes a set of imaging pixels for generating an image and a set of illuminating pixels for generating seam illumination through the seams. Seam illumination is directed through the seams directly or by a reflector integral with or attachable to the LED module or to a coupling assembly of the LED display system. The illuminating pixels may be controlled to track colour or intensity of the image being generated by imaging pixels.

23 Claims, 11 Drawing Sheets

LED MODULE SEAM ILLUMINATION

FIELD

The present disclosure relates to light emitting diode (LED) display systems, and in particular to tiled LED displays having LED modules.

BACKGROUND

A concern in the design of tiled LED display systems having LED modules, sometimes termed LED module boards, is the appearance of "dark line" defects in the seam between adjacent LED modules, especially between LED modules across adjacent LED tiles. Dark line defects refer to the visible dark lines that are sometimes visible to a viewer where the spacing between adjacent LED modules is too great for the adjacent LED modules to create the impression of a continuous image from one LED module to the next. The maximum module spacing error beyond which such dark line defects are perceived is typically approximately of 5% of the nominal pixel pitch of the LED modules. For example, a 1.2 mm nominal pixel pitch gives rise to a spacing error of 1.2×0.05=0.06 mm (60 um) such that a pixel pitch of 1.26 mm or less across module boundaries is required to avoid the perception of dark line defects by a viewer.

LED modules arranged in a tiled LED display system are therefore often spaced closely together, with minimal allowable spacing error, to avoid the appearance of dark line defects. This requirement to tightly space LED modules together results in challenging design, manufacturing, and installation requirements. Even where such requirements are followed, the occurrence of dark line defects can persist.

SUMMARY

The present disclosure relates to the reduction of dark line defects arising from seams between adjacent LED modules in a tiled direct view LED display system. The present disclosure sets forth an LED display system comprising a set of illuminating pixels for illuminating the seams between the adjacent LED modules, thereby reducing dark line defects.

According to an aspect of the disclosure, an LED display system includes a coupling assembly for securing LED modules in adjacent arrangement, a first LED module and a second LED module, the first and second LED modules having imaging sides with sets of imaging pixels disposed thereon for generating imaging illumination viewable from an imaging direction, the first and second LED modules coupled with the coupling assembly and situated adjacently to form a seam therebetween, and a set of illuminating pixels situated rearward of the first and second LED modules for generating seam illumination through the seam.

In some embodiments, the LED display system includes a control unit configured to control an imaging property in accordance with a media source, the imaging property comprising at least one of a colour and an intensity of at least one imaging pixel of the sets of imaging pixels, and control an illuminating property in accordance with an illumination scheme, the illuminating property comprising at least one of a colour and an intensity at least one illuminating pixel of the set of illuminating pixels, the illumination scheme comprising controlling the illuminating property in response to at least the imaging property.

In some embodiments, the illumination scheme includes controlling the intensity of the set of illuminating pixels to cause the seam illumination to match one of an average intensity of the set of imaging pixels of the first LED module, an average intensity of the set of imaging pixels of the second LED module, and an average intensity of the sets of imaging pixels.

In some embodiments, the first LED module has a rearward side, opposite its imaging side, and the set of illuminating pixels is disposed on the rearward side, the set of illuminating pixels is aligned in pitch with the set of imaging pixels of the first LED module such that each illuminating pixel of the set of illuminating pixels corresponds with a corresponding imaging pixel of the set of imaging pixels of the first LED module, and the illumination scheme includes tracking at least one of the colour and the intensity of the at least one illuminating pixel of the set of illuminating pixels with its corresponding imaging pixel.

In some embodiments, the first LED module has a rearward side, opposite its imaging side, and the set of illuminating pixels is disposed on the rearward side, the seam defines a plane between the first LED module and the second LED module, and the LED display system further comprises a reflector situated rearward of the first and second LED modules, the reflector extending from one of the first LED module, the second LED module, and the coupling assembly, toward the plane of the seam, to direct the seam illumination through the seam.

In some embodiments, the rearward side of the first LED module has an edge, and wherein the set of illuminating pixels is disposed along the edge.

In some embodiments, the LED display the edge of the rearward side of the first LED module is beveled.

In some embodiments, the rearward side of the first LED module has a perimeter, and the set of illuminating pixels is disposed along the perimeter.

In some embodiments, the reflector includes a series of concave portions, the series of concave portions aligned in pitch with the set of illuminating pixels.

In some embodiments, at least one of the rearward side of the first LED module and the reflector is treated with an optical coating.

In some embodiments, the reflector is reversibly attachable to the rearward side of the first LED module.

In some embodiments, the LED display system includes a first LED tile and a second LED tile coupled by the coupling assembly, and the first LED module is situated on the first LED tile and the second LED module is situated on the second LED tile and the seam is formed between the first and second LED tiles.

In some embodiments, the first LED module has a rearward side, opposite its imaging side, and the set of illuminating pixels is disposed on the rearward side, the seam defines a plane between the first LED module and the second LED module, and the LED display system further comprises a reflector situated rearward of the first and second LED modules, the reflector extending from the coupling assembly, toward the plane of the seam, to direct the seam illumination through the seam.

In some embodiments, the reflector is reversibly attachable to the rearward side of the first LED module.

According to another aspect of the disclosure, an LED module for use in an LED display system includes a set of imaging pixels disposed on a first side for generating imaging illumination, a set of illuminating pixels disposed adjacent to an edge of a second side, the second side opposite to the first side, for generating seam illumination, and a reflector extending from the second side to direct the seam illumination around the edge.

In some embodiments, the reflector comprises a series of concave portions, the series of concave portions aligned in pitch with the set of illuminating pixels.

In some embodiments, the edge of the second side is beveled.

In some embodiments, at least one of the second side and the reflector is treated with an optical coating.

According to another aspect of the disclosure, an LED tile for use in an LED display system includes a coupling assembly for securing LED modules, the coupling assembly having an edge adjacent to which at least one LED module may be situated, the at least one LED module having a set of illuminating pixels for generating seam illumination, and a reflector extending from the coupling assembly to direct the seam illumination around the edge of the coupling assembly.

In some embodiments, the reflector comprises a series of concave portions, the series of concave portions aligned in pitch with the set of illuminating pixels.

Other features and advantages of the LED display system are described more fully below.

BRIEF DESCRIPTION OF THE DRAWINGS

Non-limiting embodiments will now be described, by way of example only, with reference to the attached Figures, wherein.

DETAILED DESCRIPTION

Figure 1:
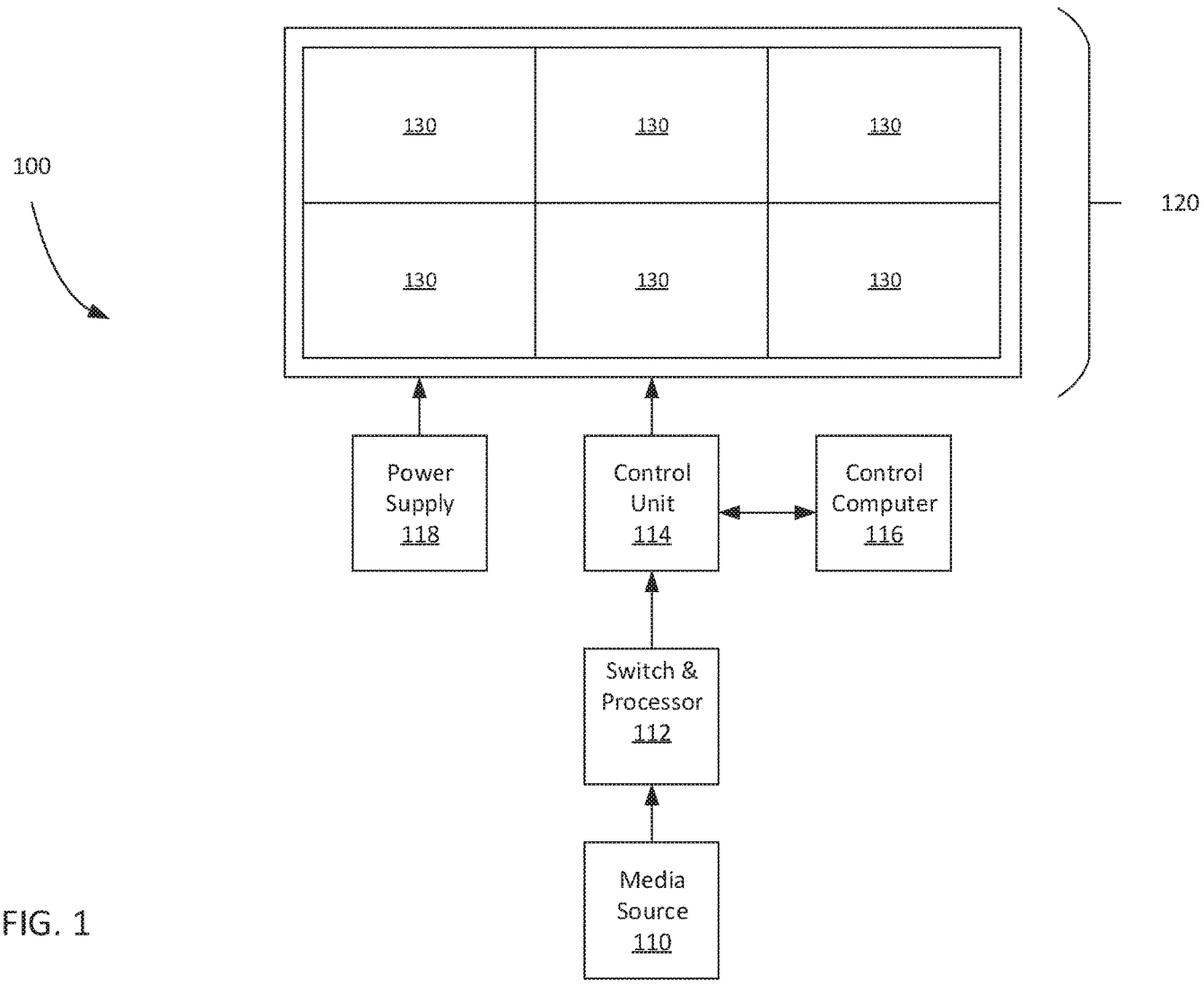
FIG. 1 is a schematic diagram of a tiled LED display system.

The present disclosure relates to the reduction of dark line defects arising from seams between adjacent LED modules, sometimes termed LED module boards, in an LED display system. Where a seam, or gap, between adjacent LED modules in an LED display system is too large for the LED display system to create the impression of a continuous image from one LED module to the next, a dark line defect can result. The occurrence of dark line defects is especially apparent between adjacent LED modules of adjacent LED tiles in a tiled LED display system.

According to the present disclosure, an LED display system has a coupling assembly for securing adjacent LED modules, including a first LED module, and at least one second LED module adjacent to the first LED module. The coupling assembly secures the first and second LED modules in adjacent arrangement within LED tiles and between LED tiles.

The LED modules have sets of imaging pixels, situated on the imaging sides thereof, for generating an image viewable from an imaging direction. At least the first LED module also has a set of illuminating pixels, situated on the rearward side opposite the imaging side, for illuminating the seams between adjacent LED modules. In some embodiments, the illuminating pixels illuminate the seam between adjacent LED modules across adjacent LED tiles. In some embodiments, the illuminating pixels provide illumination which is reflected off a reflector and directed toward the seam, thereby illuminating the seam and reducing dark line defects. Reducing dark line defects may generally improve the appearance of the image generated by the LED display system, and allow for greater flexibility in seam tolerances in LED display system manufacture and assembly.

In some embodiments, the LED display system may have a control unit for controlling the imaging pixels, and for controlling the illuminating pixels in response to the image being generated such that the seam illumination blends in colour or intensity with the image being generated by the imaging pixels.

In some embodiments, the imaging pixels and the illuminating pixels may use the same or similar LED chips, and the illuminating pixels may be aligned in pitch with the imaging pixels.

In some embodiments, physical components of the LED display system or the LED modules may be designed to improve optical coupling from the illuminating pixels toward the seam. For example, the rearward side of the LED modules may be beveled toward the seam to improve optical coupling. As another example, the reflector may incorporate a series of concave portions aligned with each illuminating pixel for more precisely directing illumination toward the seam. As another example, portions of the LED display system or LED module may be treated with optical coatings, such as diffuse coatings or reflective coatings, to achieve desirable optical properties.

Non-limiting embodiments of an LED display system having LED modules which may exhibit a dark line defect is presented in the following FIGS. 1-4. For convenience, reference numerals may be repeated (with or without an offset) to indicate analogous components or features.

FIG. 1 is a schematic diagram of an LED display system 100, according to a non-limiting embodiment. The LED display system 100 comprises a media source 110 which provides an input, such as an image feed or a video feed to be displayed by the LED display system 100. The media source 110 may comprise a computing device, a DVD, CD-ROM, or other media player, a camera, camcorder, or any other media device capable of providing an image or video feed to the LED display system 100.

The LED display system 100 further comprises a video matrix switch and splicing video processor 112, hereinafter referred to as a switch & processor 112. The switch & processor 112 receives an image feed or video feed from at least one media source 110. In embodiments in which multiple media source 110 are connected to the LED display system 100, the switch & processor 112 is configurable to select a single media source 110, or to blend & process multiple media sources 110, for display by the LED display system 100.

The LED display system 100 further comprises a control unit 114, a control computer 116, and an LED display 120. The control unit 114 receives the image or video feed from switch & processor 112, and contains software, hardware, or firmware instructions for controlling the LED display 120 to display the image feed or video feed (hereinafter referred to simply as the image). The control computer 116 comprises a computing device in communication with control unit 114 configured to provide additional computation or control capacity to the control unit 114 for altering display to the LED display 120.

Figure 2:
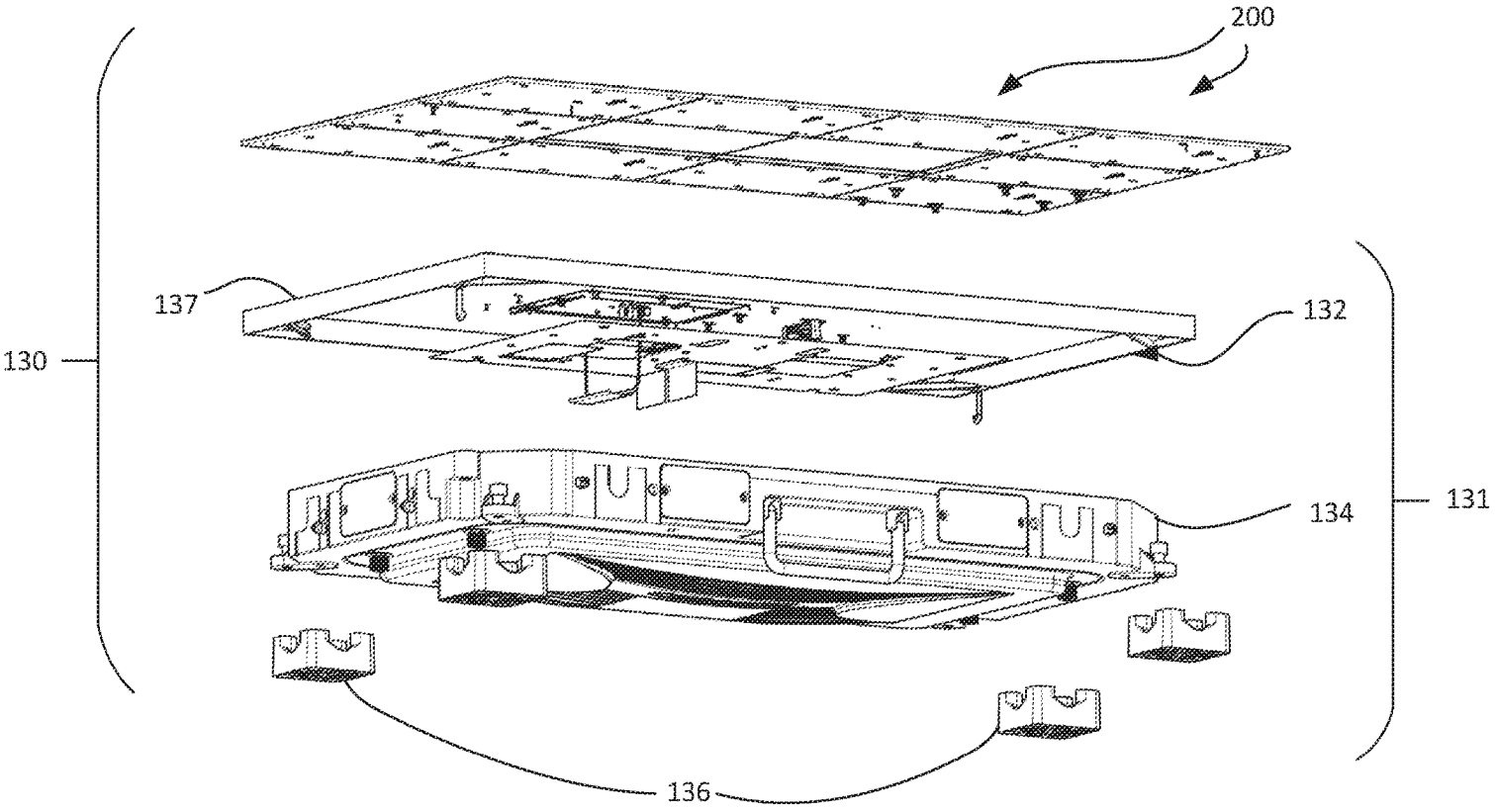
FIG. 2 is an assembly drawing of an LED tile having several adjacent LED modules.

The LED display 120 comprises several LED tiles 130 in adjacent arrangement. With reference to FIG. 2, and with continued reference to FIG. 1, it can be seen that each LED tile 130 contains several LED modules 200 in adjacent arrangement. The LED modules 200 comprise several pixels, controlled by control unit 114, for generating the image to be displayed by the LED display 120. The LED display system 100 further comprises a power supply 118 for powering the LED tiles 130.

FIG. 2 is an assembly drawing of an LED tile 130, according to a non-limiting embodiment. The LED tile 130 comprises a carrier assembly 132 for coupling with several LED modules 200 in adjacent arrangement. The carrier assembly 132 is secured into a chassis 134. The tile chassis 134 has attachment points for mounting blocks 136, which may be used to mount and arrange several LED tiles 130 adjacently into the LED display 120. The carrier assembly 132 has side edges 137 against which LED modules 200 may be adjacently situated.

The carrier assembly 132, chassis 134, and mounting blocks 136 may be referred to collectively as coupling assembly 131. However, the term coupling assembly 131 is not thereby limited, and may be used to refer to several carrier assemblies 132, chassis 134, and mounting blocks 136, employed to arrange several LED tiles 130 in adjacent arrangement. Furthermore, the term coupling assembly 131 may refer to an individual carrier assembly 132, where adjacent LED modules 200 are of concern. In sum, the term coupling assembly 131 may be used generally to refer to any structure in an LED display system for arranging LED modules 200 in adjacent arrangement within an LED tile 130 or across adjacent LED tiles 130.

Figure 3:
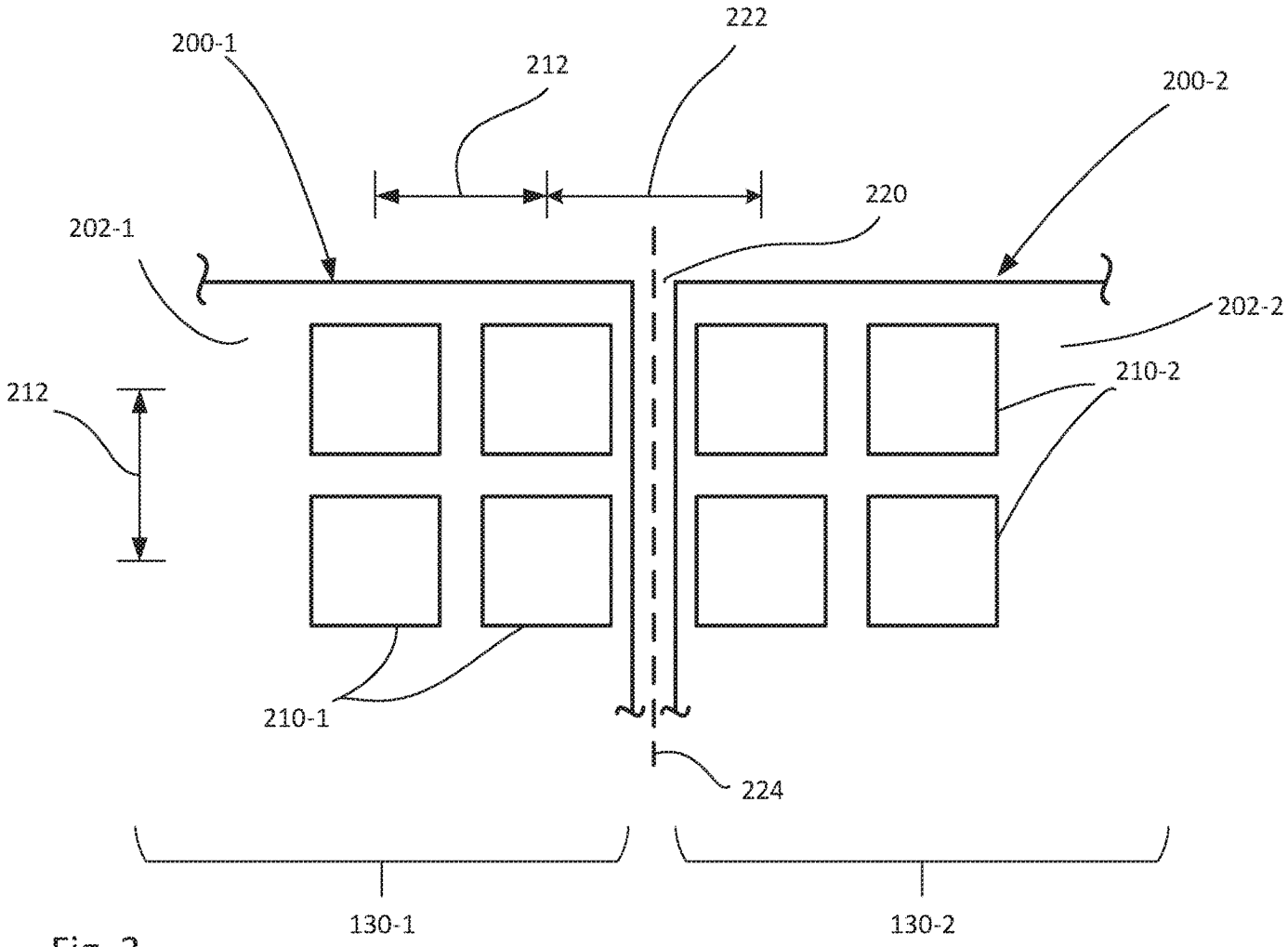
FIG. 3 is an enlarged schematic diagram showing corner portions of two adjacent LED modules and a seam therebetween.

FIG. 3 is an enlarged schematic drawing of two adjacent LED modules 200, indicated as LED modules 200-1 and 200-2. Each LED module 200-1, 200-2 is shown from its imaging (front) side 202-1, 202-2, which features sets of imaging pixels 210-1, 210-2, disposed thereon. Each LED module 200-1, 200-2 has a rearward side 204-1, 204-2 (see FIGS. 5B and 6-11), opposite the imaging sides 202-1, 202-2. On the imaging side 202-1, 202-2, the imaging pixels 210-1, 210-2 are spaced apart according to a common pitch distance 212.

In the present embodiment, an imaging pixel 210-1, 210-2 comprises a group of one red, one green, and one blue LED. Each red, green, and blue LED may be referred to as a subpixel. In the present embodiment, each subpixel comprises an LED chip, and each LED module 200-1, 200-2 comprises a printed circuit board (PCB) having an array of LED chips on imaging sides 202-1, 202-2.

The two LED modules 200-1, 200-2, are arranged adjacently on the carrier assembles 132-1, 132-2 (not shown), and are separated by a space, gap, or seam, indicated as seam 220. In the present embodiment, LED module 200-1 is situated on an LED tile 130-1, and LED module 200-2 is situated on an adjacent LED tile 130-2. Thus, the seam 220 is between adjacent LED tiles 130-1, 130-2. However, in other embodiments, LED modules 200-1 and 200-2 may be situated on an individual LED tile 130, with the seam 220 being between LED modules 200-1, 200-2, within LED tile 130.

Figure 6:
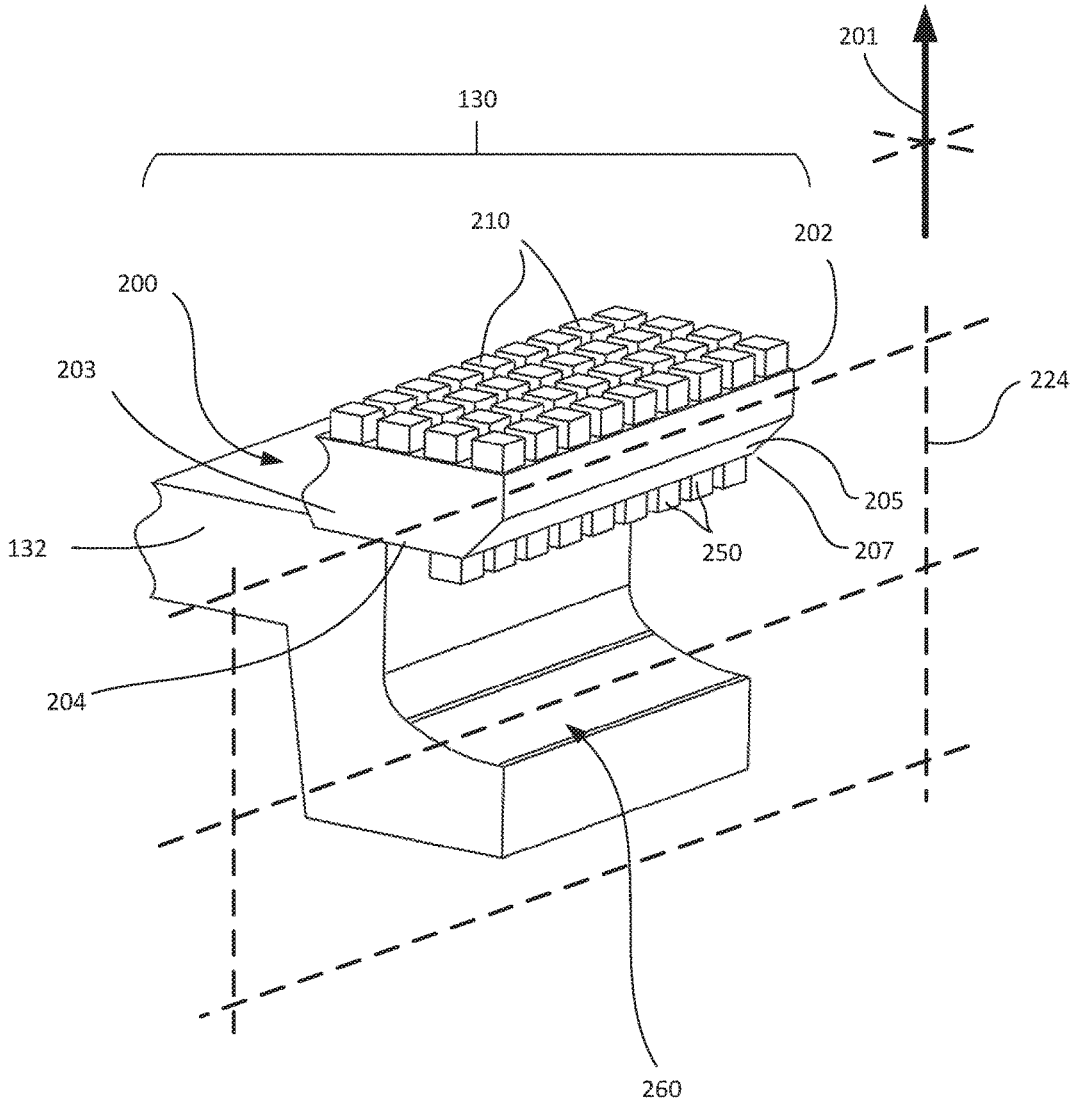
FIG. 6 is a partial perspective view of an LED module on an LED tile, showing a plane defined by a seam between the LED module and an LED module of an adjacent LED tile.

The seam 220 defines a plane 224 spanning the space between LED modules 200-1, 200-2 (best shown in FIG. 6). The seam 220 causes an effective pitch distance across LED modules 200-1, 200-2, indicated as seam pitch distance 222. Typically, the installation of LED tiles 130-1 and 130-2 is confined such that the size of the seam 220 is minimal, and such that seam pitch distance 222 is about equal to pitch distance 212. Thus, the impression of a continuous image from LED module 200-1 on LED tile 130-1 to LED module 200-2 on LED tile 130-2 is created with no dark line defects. As discussed above, the maximum module spacing error beyond which such dark line defects are perceived is typically approximately 5% of the nominal pixel pitch, i.e. pitch distance 212, of the LED modules 200-1, 200-2. Strict practices in design, manufacturing, and installation, are often imposed to achieve such tight tolerances. However, even where such practices are employed, seam pitch distance 222 may vary significantly from pitch distance 212, and the occurrence of dark line defects may persist, as shown in FIG. 4 and discussed below.

Figure 4:
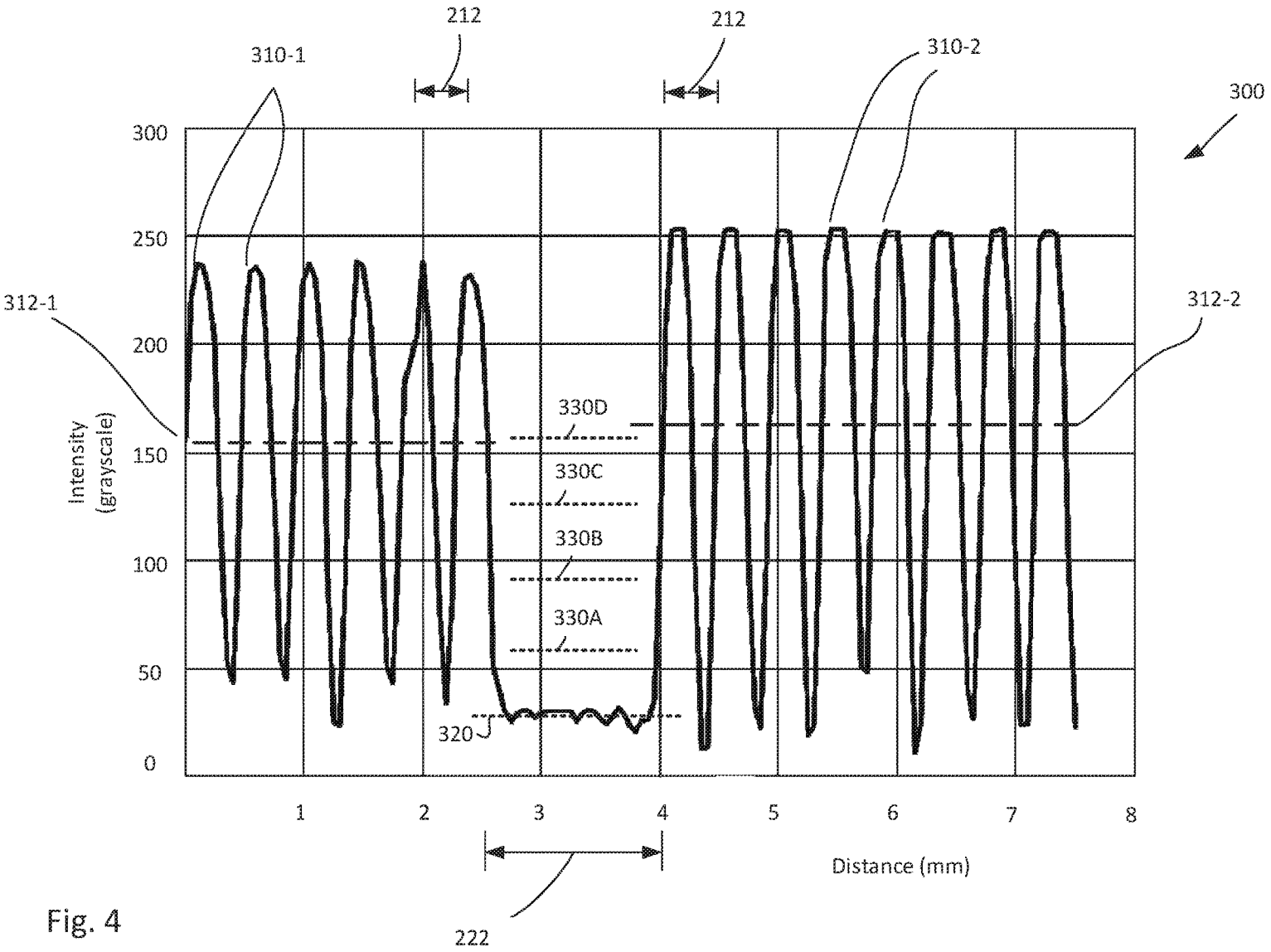
FIG. 4 is an intensity plot indicating pixel intensity of two adjacent LED modules.

FIG. 4 is an intensity plot 300 indicating pixel intensity of two adjacent LED modules 200-1, 200-2, according to a non-limiting embodiment. As an example, plot 300 shows the intensity of each imaging pixel 210-1, 210-2, of LED modules 200-1, 200-2, situated on LED tiles 130-1, 130-2, respectively, indicated as grayscale peaks 310-1 and 310-2, respectively. It can be seen that peaks 310-1 and 310-2 have a common pitch distance 212, which in the present example is about 0.6 mm. On the left-hand side of the plot, it can be seen that the imaging pixels 210-1 on LED module 200-1, on LED tile 130-1, peak at about 240 grayscale, whereas on the right-hand side of the plot, it can be seen that the imaging pixels 210-2 on LED module 200-2, on LED tile 130-2, peak at about 255 grayscale. Furthermore, the average intensity 312-1 is at about 160 grayscale, and the average intensity 312-2 is at about 170 grayscale. The difference in intensity may represent different images or sections of an image displayed by each respective LED tile 130-1, 130-2.

The peaks 310-1 of LED module 200-1 are separated from the peaks 310-2 of LED module 200-2 by seam pitch distance 222, which in the present example is about 1.4 mm. Seam pitch distance 222 is exaggerated to represent a large gap, or seam 220, between LED tiles 130-1, 130-2, that may produce a dark line defect. The average intensity across seam 220, indicated as seam intensity 320, is about 30 grayscale, representing a noticeable dark line defect given the large seam pitch distance 222.

Increasing seam intensity 320 by filling the seam 220 with additional illumination may reduce dark line defects. Thus, plot 300 further indicates non-limiting examples of intensity levels to which it may be desirable to increase seam intensity 320 in order to reduce the visibility of a dark line defect. For example, in some embodiments, it may be desirable for seam intensity 320 to reach about one quarter, about one half, or about three quarters, of the average intensity of the LED modules 200-1, 200-2, or the combination thereof, indicated as intensity values 330A, 330B, and 330C, respectively. In such embodiments, either LED module 200-1 or 200-2, or the combination thereof, may be used as a reference point for average intensity (average intensities 312-1 or 312-2).

In other embodiments, it may be desirable for seam intensity 320 to match the average intensity of an LED module 200-1, 200-2. In such embodiments, as above, either LED module 200-1 or 200-2, or the combination thereof, may be used as a reference point for average intensity (average intensities 312-1 or 312-2). A seam intensity 320 matching the combination of LED modules 200-1, 200-2, is indicated as intensity value 330D.

Controlling seam intensity 320 in response to pixel intensities of nearby LED modules 200-1, 200-2 as discussed above may be referred to as an illumination scheme. In the illumination schemes described above, the desirable intensity values presented here are exemplary only, as any increase in the intensity of illumination across seam 220 may reduce dark line defects.

Non-limiting embodiments of LED modules 200, which may reduce the occurrence or severity of dark line defects, are presented in FIGS. 5-9 below. For convenience, reference numerals, including those originating from FIGS. 1-4, may be repeated to indicate analogous components or features.

Figure 5A:
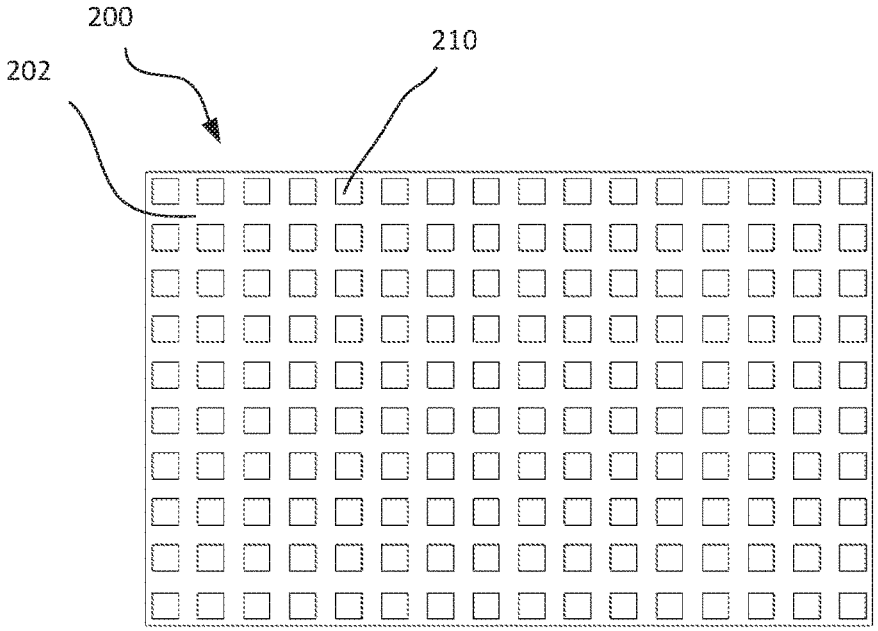
FIG. 5A is a schematic diagram of the imaging side of an LED module having a set of imaging pixels thereon.

FIG. 5A is a schematic diagram of an LED module 200, according to a non-limiting embodiment. LED module 200 comprises an imaging (front) side 202, having set of imaging pixels 210 thereon. By way of example only, the LED module 200 is shown as having a resolution of 10×16 pixels and configured in a regular array, but any resolution or configuration of imaging pixels 210 is contemplated.

Figure 5B:
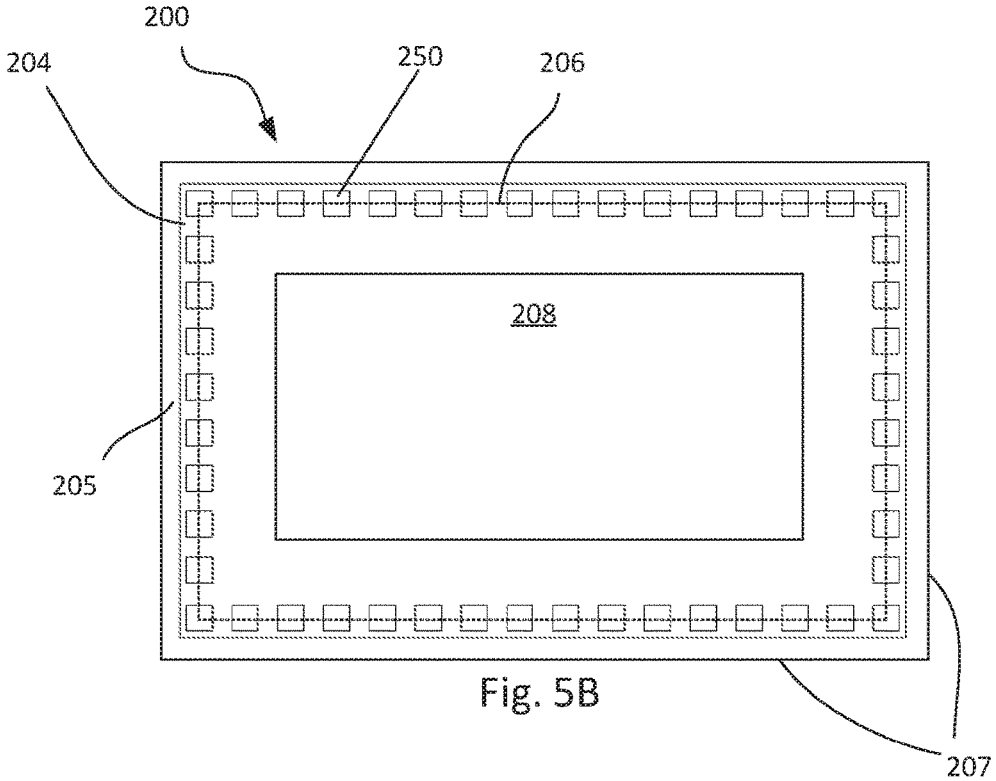
FIG. 5B is a schematic diagram of the rear side of an LED module having a set of illuminating pixels around the perimeter thereof.

FIG. 5B is a schematic diagram of LED module 200, viewed from a rearward direction. LED module 200 includes rearward side 204, opposite the imaging side 202, having a set of illuminating pixels 250 disposed thereon.

The rearward side 204 comprises edges 207. The rearward side 204 has a perimeter, and in the present embodiment, illuminating pixels 250 are situated around the perimeter 206. The perimeter 206 need not be situated precisely at the edges 207 of rearward side 204, but may be offset inward of the edges 207, as shown, to provide sufficient clearance for illuminating pixels 250 from the edges 207.

In the present embodiment, the illuminating pixels 250 are situated around perimeter 206 in a single layer such that each illuminating pixel 250 is close in proximity to a seam 220 between the LED module 200 and an adjacent LED module. Such embodiments may be desirable to facilitate inclusion of a reflector extending from the rearward side 204 of the LED modules 200, as discussed below. Such embodiments may also be desirably where only a single layer of pixels is necessary to illuminate a seam 220. In other embodiments, however, multiple layers of illuminating pixels 250 may be employed to provide additional seam illumination.

In the present embodiment, the edges 207 are beveled, indicated as bevel 205, around perimeter 206, for improving optical coupling around the edges 207, a feature discussed in greater detail below.

In the present embodiment, the rearward side 204 further provides interior space 208 as space for coupling with a carrier assembly 132, providing electrical connections to control unit 114, or for providing attachment with a reflector, as discussed below.

In the present embodiment, each illuminating pixels 250 comprises a group of one red, one green, and one blue LED. In the present embodiment, each subpixel comprises an LED chip that is the same or similar to the LED chips used in imaging pixels 210. However, in other embodiments, imaging pixels 210 and illuminating pixels 250 may comprise dissimilar LED chips. For example, in some embodiments it may be desirable for illuminating pixels 250 may vary in form factor, power supply voltage, color depth, LED type, or other characteristics from imaging pixels 210.

FIG. 6 is a partial perspective view of the LED module 200, according to a non-limiting embodiment. LED module 200 includes set of imaging pixels 210 on imaging side 202 and set of illuminating pixels 250 on rearward side 204. LED module 200 includes module body 203 between sides 202, 204. Module body 203 comprises a printed circuit board having electrical connections for imaging pixels 210, illumination pixels 250, and communication with control unit 114.

Direction 201 indicates the general direction in which illuminating pixels 250 generate imaging illumination. Plane 224 indicates a plane which would be defined by a seam 220 between the LED module 200 and an adjacent LED module. In the present embodiment, LED module 200 is situated on an LED tile 130, and the seam 220 is between LED tiles 130, and an adjacent LED tile 130 (not shown).

FIG. 6 further shows a reflector 260, integral with a coupled carrier assembly 132 of LED tile 130, and extending rearwardly from rearward side 204, and curving toward the plane 224, as described in greater detail in FIG. 7 below.

In the present embodiment, the rearward side 204 is shown having an edge 207, beveled at about 45 degrees to form bevel 205, to improve optical coupling of illumination directed toward the seam 220. However, it is contemplated that in other embodiments, edge 207 may not be beveled, or that the bevel 205 may be made at other angles, or curved, in order to improve optical coupling toward the seam 220.

Figure 7:
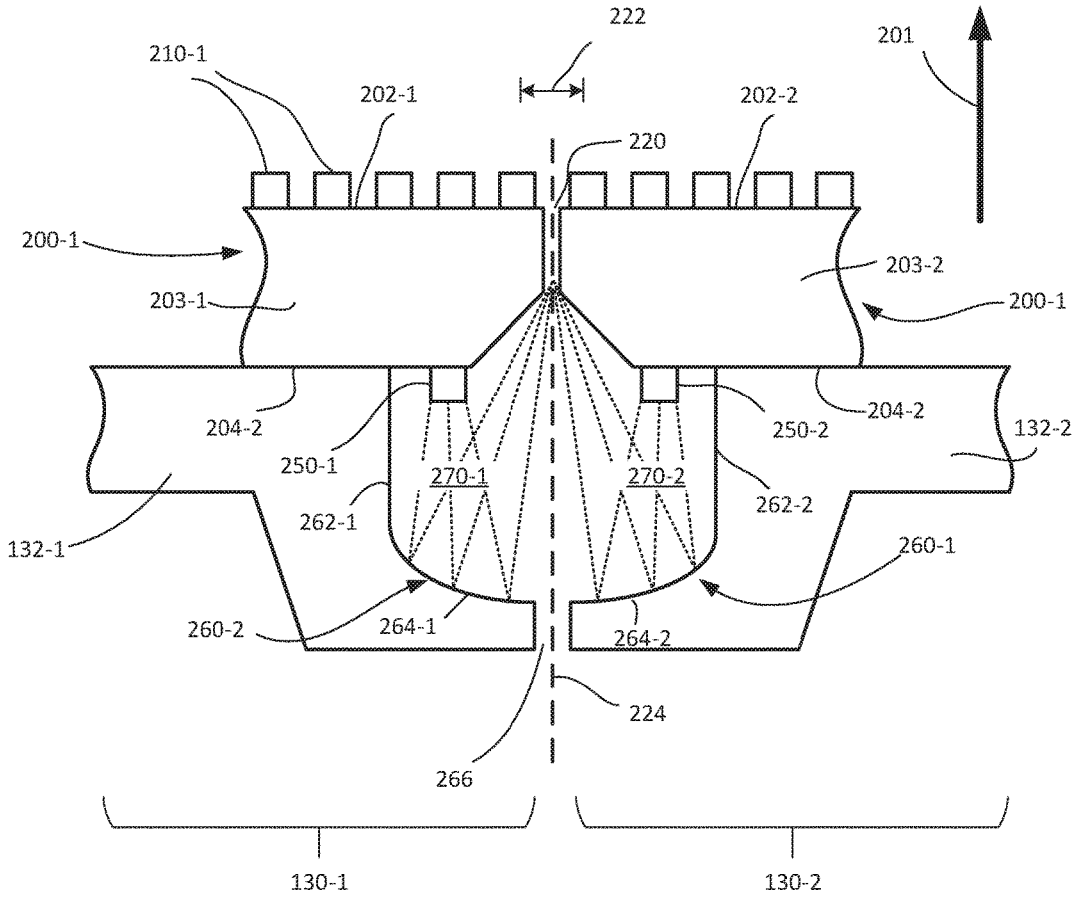
FIG. 7 is a partial sectional view of two adjacent LED modules of two adjacent LED tiles having illuminating pixels on the rear sides thereof and reflectors for illuminating a seam between the two adjacent LED modules.

FIG. 7 is a partial sectional view of two adjacent LED modules 200-1, and 200-2, according to a non-limiting embodiment. The LED modules 200-1, 200-2 are situated on LED tiles 130-1, 130-2, respectively, and have a seam 220 therebetween, which defines a plane 224, and which results in a seam pitch distance of 222. Imaging pixels 210-1, 210-2 are situated on imaging sides 202-1, 202-2 to generate imaging illumination in the imaging (forward) direction 201. The LED modules 200-1, 200-2, have illuminating pixels 250-1, 250-2 on the rear sides 204-1, 204-2 thereof for generating seam illumination 270-1, 270-2.

The carrier assemblies 132-1, 132-2 include integral reflectors 260-1, 260-2, extending from rearward sides 204-1, 204-2 of LED modules 200-1, 200-2, and curving toward the plane 224. In the present embodiment, each reflector 260-1, 260-2 is integral with its corresponding carrier assembly 132-1, 132-2, and each reflector 260-1, 260-2 comprises an elongated portion 262-1, 262-2 and a curved portion 264-1, 264-2. The elongated portions 262-1, 262-2 generally extend in the rearward direction, opposite the imaging direction 201, from the rearward sides 204-1, 204-2. The elongated portions 262-1, 262-2 terminate at curved portions 264-1, 264-2, which extends generally toward the plane 224. Curved portions 264-1, 264-2 are curved to reflect and direct seam illumination 270-1, 270-2 generally toward and through seam 220.

In the present embodiment, it can be seen that the curved portions 264-1, 264-2 terminate before reaching the plane 224, leaving an opening 266 that is at least as wide as seam 220. The opening 266 is sufficiently wide so as to not interfere with the adjacent arrangement of LED tiles 130-1, 130-2.

In operation, rearward illumination from illuminating pixels 250, indicated generally as seam illumination 270-1, 270-2, is generated by illumination pixels 250-1, 250-2, and reflected off the reflectors 260-1, 260-2, and particularly curved portions 264-1, 264-2, toward seam 220. The seam illumination 270-1, 270-2 is directed through seam 220 and generally in the imaging direction 201. Thus, where the seam pitch distance 222 is sufficiently great to develop a dark line defect between LED modules 200-1, 200-2, the severity of the dark line defect may be reduced.

Module bodies 203-1, 203-2 each comprises a printed circuit board having electrical connections for imaging pixels 210-1, 210-2, illumination pixels 250-1, 250-2, and communication with control unit 114. In some embodiments, the illumination pixels 250-1, 250-2 are controlled according to an illumination scheme. As discussed above, illumination pixels 250-1, 250-2 may be configured to develop a seam intensity 320 approaching about one quarter, one half, or about three quarters, of the average intensity of any combination of the LED modules 200-1, 200-2 on which the illumination pixels 250-1, 250-2 are disposed or adjacent LED modules 200-1, 200-2. In some embodiments, seam intensity 320 may approach or approximately equal the average pixel intensity of the LED modules 200-1, 200-2 on which the illumination pixels 250-1, 250-2 are disposed or an adjacent LED module 200-1, 200-2. Further, in some embodiments, the colour of illumination pixels 250-1, 250-2 may match that of imaging pixels 210-1, 210-2.

The illumination schemes discussed above may be referred to as involving control of an illuminating property (a colour or intensity of an illumination pixel 250-1, 250-2) in response to an imaging property (a colour or intensity of an imaging pixel 210-1, 210-2). In general, the term imaging property can be used to refer to an intensity or colour of at least one pixel in the set of imaging pixels 210-1, 210-2. In other words, an imaging property may refer to the colour or intensity of any pixel contributing to an image being generated. Similarly, the term illuminating property can be used to refer to an intensity or colour of at least one pixel in the set of illuminating pixels 250-1, 250-2. In other words, an illuminating property may refer to the colour or intensity of any pixel contributing to seam illumination 270-1, 270-2. Thus, according to an illumination scheme, an illuminating property may be controlled in response to, to conform with, or to track, an imaging property, so that the seam 220 is filled with light from illuminating pixels 250 that blends or matches the image being generated by imaging pixels 210-1, 210-2.

In some embodiments in which the image generated by imaging pixels 210-1, 210-2 is dynamic, such as where the image generated is part of a video, the illuminating pixels 250-1, 250-2 may be controlled dynamically by control unit 114 in response to changing imaging properties.

Referring again to FIGS. 5A, 5B, and 6, it can be seen that in some embodiments, the illuminating pixels 250 may be aligned in pitch with imaging pixels 210. In such embodiments, each illuminating pixel 250 may correspond with an imaging pixel 210. In such embodiments, the illumination scheme may comprise controlling an illuminating property of each illuminating pixel 250 in response to an imaging property of its corresponding imaging pixel 210. Thus, seam illumination 270 may be controlled to accurately blend with imaging illumination from the illuminating pixels 250 and may track the colours and intensities on a pixel-by-pixel basis of the image generated by the imaging pixels 210. In other embodiments, illuminating pixels 250 may not be aligned in pitch with imaging pixels 210, provided the illuminating pixels 250 provide seam illumination 270 through seam 220.

In some embodiments, portions of the reflectors 260, module body 203, bevel 205, or other structures may be treated with optical coatings, such as diffuse coatings or reflective coatings, to achieve desirable optical properties.

FIGS. 8A, 8B, 8C, and 8D further depict non-limiting embodiments of LED modules 200A, 200B, 200C, and 200D, in which several configurations of LED modules 200 and reflectors 260 are contemplated.

Figure 8A:
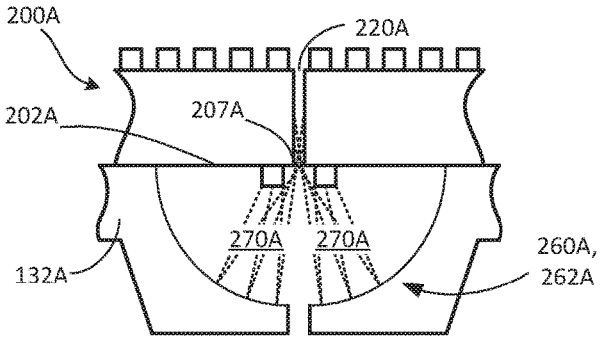
FIG. 8A is a partial sectional view of two adjacent LED modules of two adjacent LED tiles having continuously curved reflectors.

In FIG. 8A, the LED module 200A has a reflector 260A comprising a continuously curved portion 262A extending from the from the rearward side 202A, integral with a carrier assembly 132A. Thus, it can be seen that the shape of the reflector 260A may vary, provided that its shape directs seam illumination 270A through seam 220A. Furthermore, edge 207A is not beveled, but rather straight-edged toward seam 220A. Thus, it can be seen that beveling an edge 207 may be desirable but is optional.

Figure 8B:
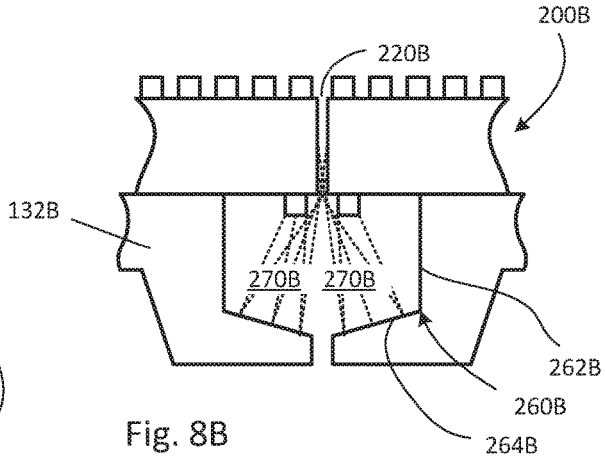
FIG. 8B is a partial sectional view of two adjacent LED modules of two adjacent LED tiles having straight-angled reflectors.

In FIG. 8B, the LED module 200B has a reflector 260B comprising an extending portion 262B, and further comprising a straight-angled portion 264B in place of a curved portion 264, integral with a carrier assembly 132B. In other embodiments, LED module 200B may comprise several straight-angled portions 262B positioned at varying angles. Thus, it can be seen that the shape of a reflector 260 may vary provided it reflects seam illumination 270B toward a seam 220B.

Figure 8C:
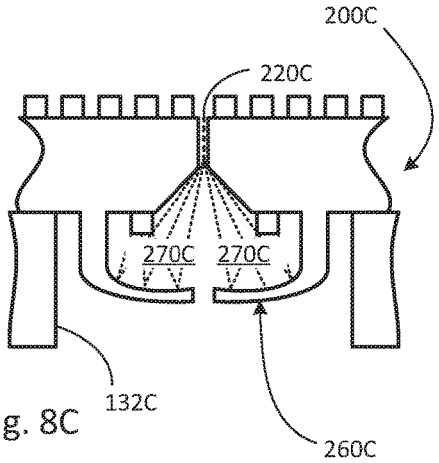
FIG. 8C is a partial sectional view of two adjacent LED modules of two adjacent LED tiles having reflectors integral to the LED modules.

In FIG. 8C, the LED module 200C comprises a reflector 260C that is integral with the LED module 200C rather than integral with carrier assembly 132C. Thus, it can be seen that the location of a reflector 260 may vary provided it reflects seam illumination 270C toward a seam 220C.

In other embodiments not shown, a reflector 260 may be reversibly attachable to the LED module 200, or the carrier assembly 132, chassis 134, or other structure of the LED display 120.

Figure 8D:
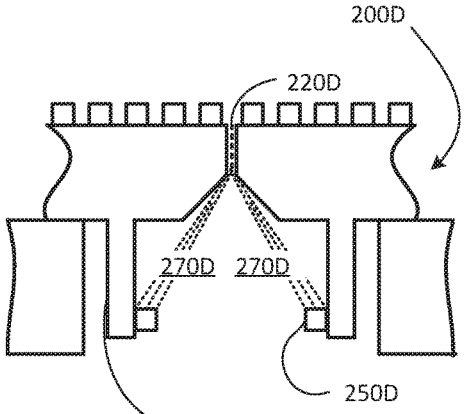
FIG. 8D is a partial sectional view of two adjacent LED modules of two adjacent LED tiles.

In FIG. 8D, the LED module 200D comprises an extending portion 262D on which illuminating pixels 250D are disposed. The illuminating pixels 250D are angled to direct seam illumination 270D generally toward the seam 220D without reflection off a reflector.

Figure 9:
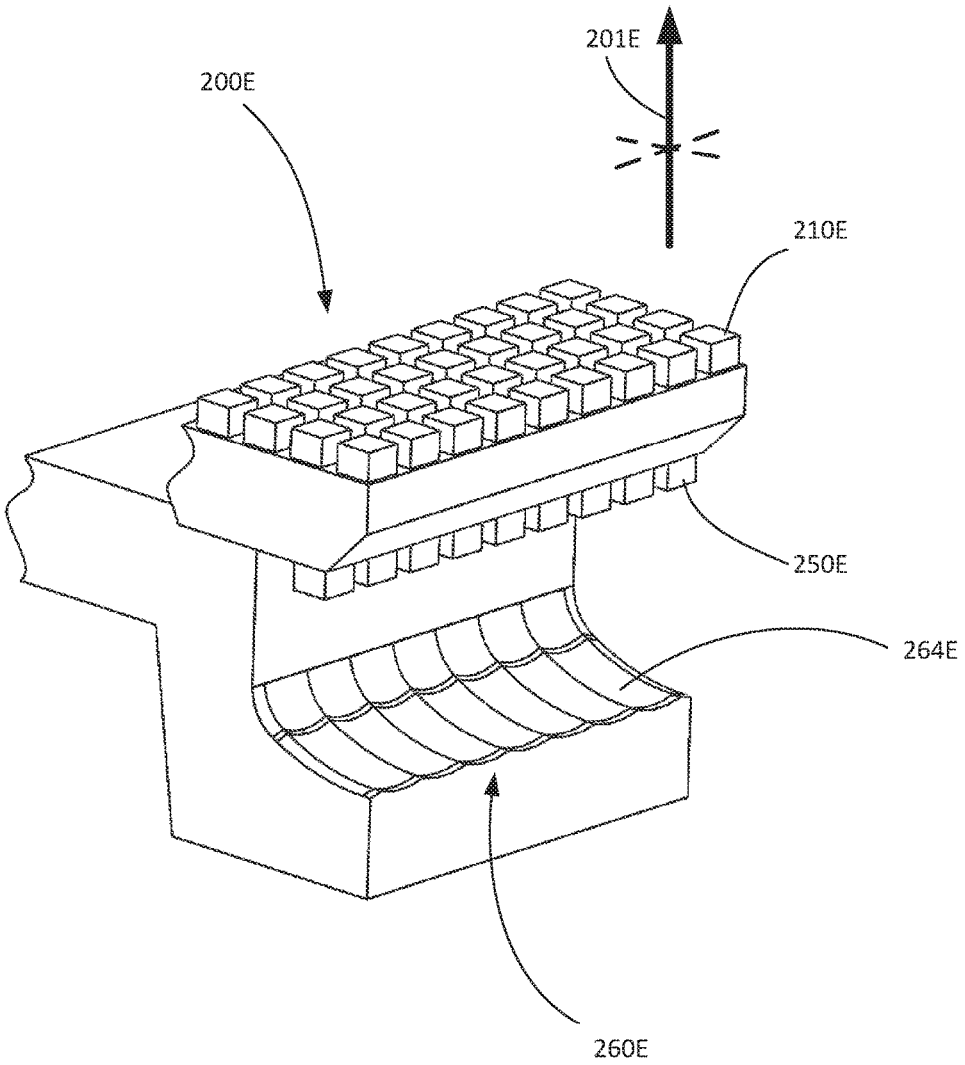
FIG. 9 is a partial perspective view of an LED module on an LED tile having a reflector having a series of concave portions.

FIG. 9 is a partial perspective view of an LED module 200E according to another non-limiting embodiment. LED module 200E has a reflector 260E comprising a series of curved portions 264E. In some embodiments, as shown, the curved portions 264E may align in pitch with an illuminating pixels 250E situated above the curved portion 264E in the imaging direction 201E. Thus, seam illumination 270E is more precisely directed toward a seam 220E. Furthermore, in some embodiments in which each illuminating pixel 250E corresponds with an imaging pixel 210E, seam illumination 270E from an illuminating pixel 250E is more precisely directed toward a seam 220E near its corresponding imaging pixel 210E, and when controlled in intensity and colour by a control unit 114, thereby more precisely tracks the image being generated by imaging pixels 210E.

Figure 10:
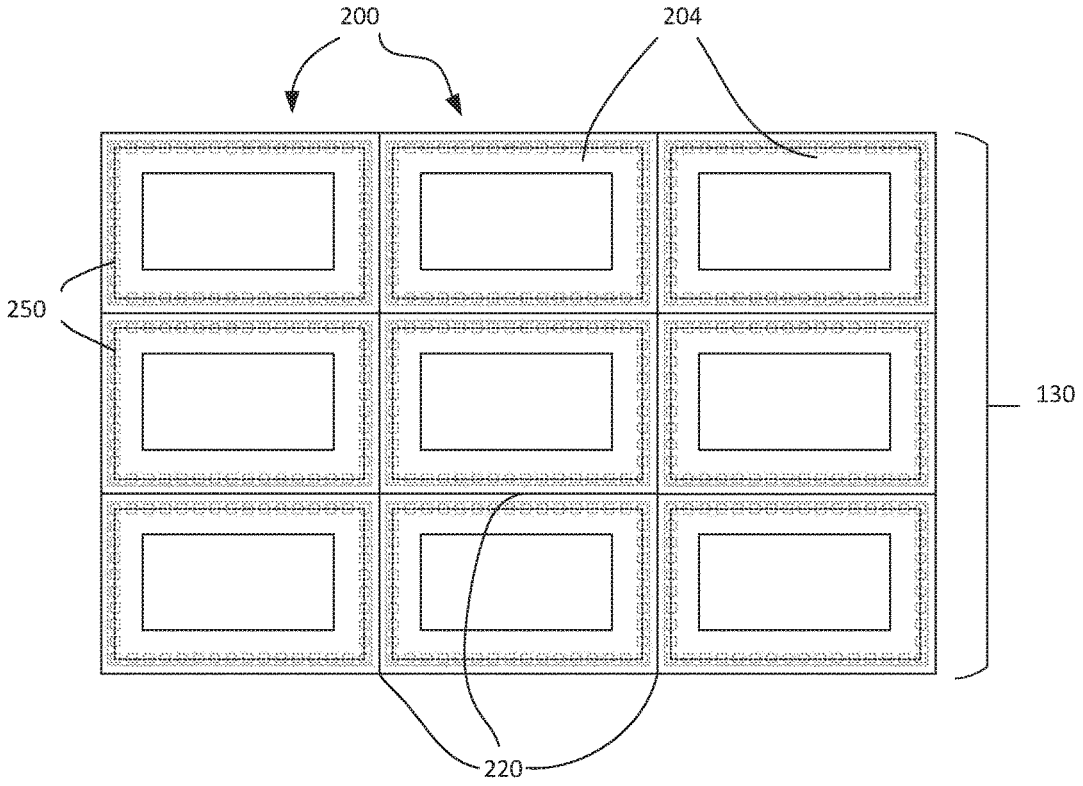
FIG. 10 is a schematic diagram of the rear side of an LED tile having LED modules having sets of illuminating pixels around the perimeters thereof.

Although in the present figures, only a single seam 220 is shown between two adjacent LED modules 200, it will be understood that in an arrangement of several LED modules 200 there may be several seams 220. For example, as shown in FIG. 10, LED modules 200 on LED tile 130 will have seams 220 between two, three, or four adjacent LED modules 200, with each seam 220 being illuminated. Furthermore, it will be understood that other embodiments may exist in which LED modules 200 take on other shapes, provided the shapes may be arrange adjacently with a seam 220 therebetween.

Figure 11A:
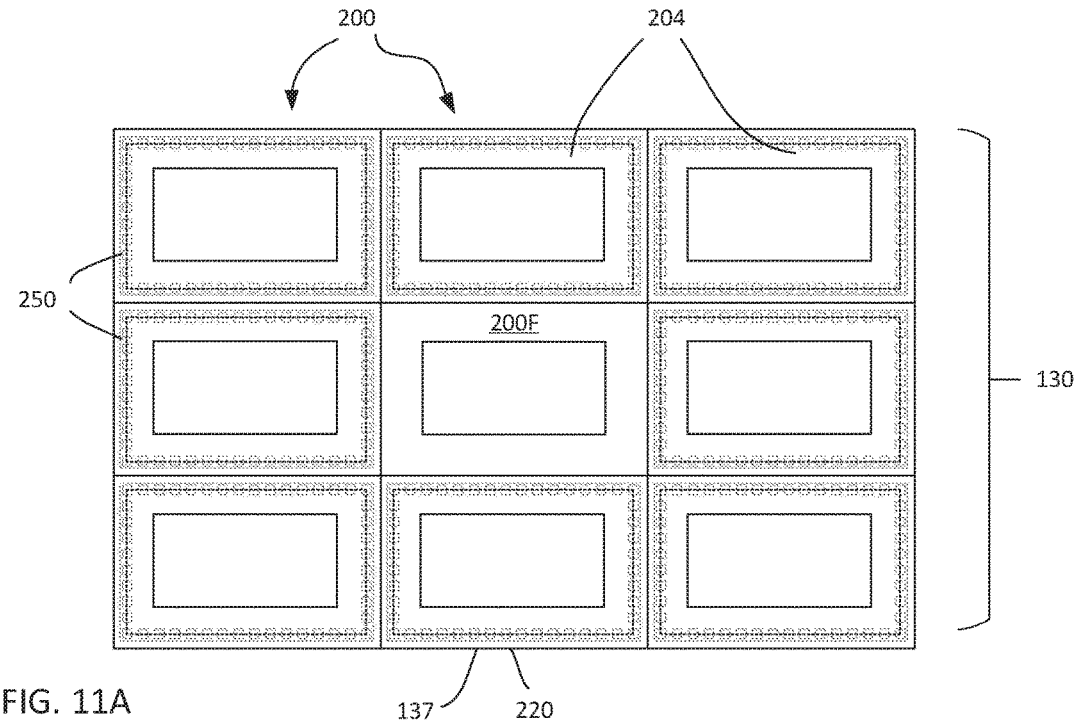
FIG. 11A is a schematic diagram of the rear side of an LED tile having LED modules having sets of illuminating pixels adjacent to the side edges of the LED tile.

Furthermore, in embodiments in which the seam 220 of concern is between adjacent LED tiles 130, seam illumination 270 is to be directed around side edges 137 (see FIG. 2) of LED tiles 130, as shown in FIG. 11A. In such embodiments, LED modules 200F without illuminating pixels 250 may be used in the interior of the LED tile 130, whereas LED modules 200 having illuminating pixels 250 may be situated around the perimeter of the LED tiles 130. Such arrangements may save energy where the seam 220 of concern is around LED tile 130 rather than between adjacent LED modules 200 within LED tile 130.

Figure 11B:
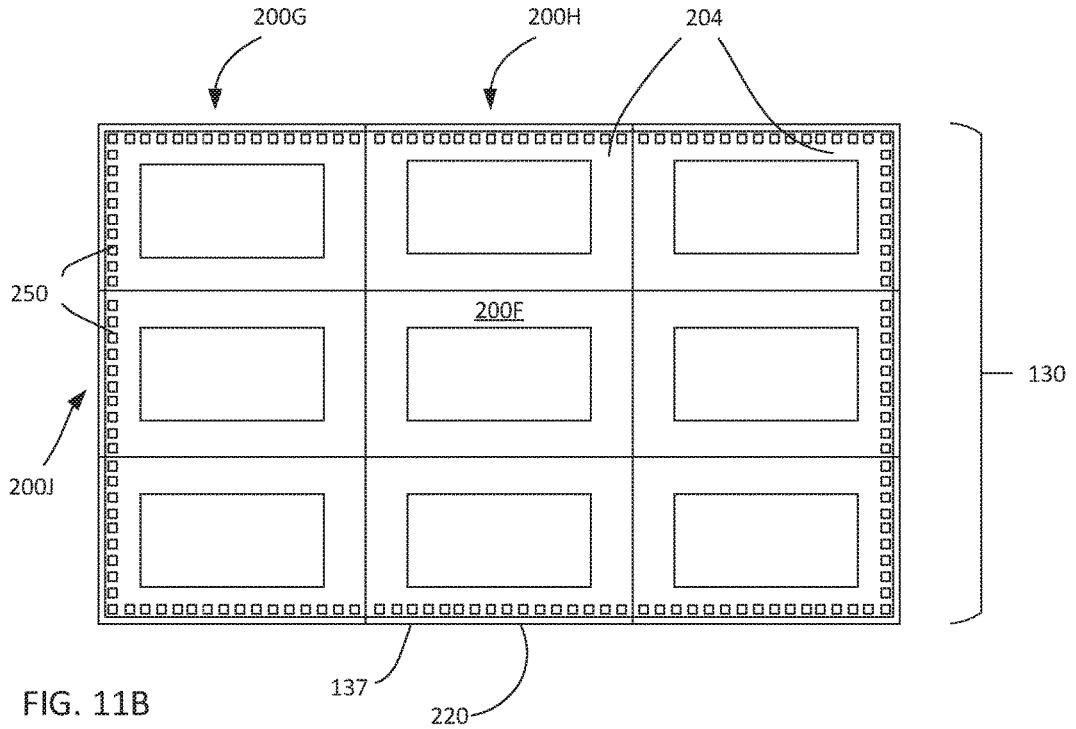
FIG. 11B is a schematic diagram of the rear side of an LED tile having LED modules having sets of illuminating pixels along the side edges of the LED tile.

Further still, in embodiments in which the seam 220 of concern is between adjacent LED tiles 130, and in which seam illumination 270 is to be directed around side edges 137 of LED tiles 130, modified LED modules 200 having illuminating pixels 250 along the edges 207 which abut against side edges 137 of LED tiles 130 may be employed, as shown in FIG. 11B. In such embodiments, corner LED modules 200G, long-side LED modules 200H, and short-side LED modules 200J, each having illuminating pixels 250 only around the edges 207 which abut side edges 137 of LED tiles 130, may be employed. Such arrangements may save energy where the seam 220 of concern is around LED tile 130 rather than between adjacent LED modules 200 within LED tile 130. Similar to FIG. 11A, LED modules 200F without illuminating pixels 250 may be used in the interior of the LED tile 130.

Thus, it can be seen that an LED display system can be provided having LED modules providing seam illumination to reduce dark line defects. Seam illumination can be generated by illuminating pixels on the rearward side of LED modules, directed through the seam by a reflector, and may be controlled in colour or intensity to blend with the image being produced by the LED module. Thus, greater flexibility in seam tolerances in design, manufacturing, and installation requirements is enabled, and the incidence or severity of dark line defects may be reduced, improving the appearance of the image generated by the LED display system.

The scope of the claims should not be limited by the embodiments set forth in the above examples, but should be given the broadest interpretation consistent with the description as a whole.

The invention claimed is:

1. An LED display system comprising:

a coupling assembly for securing LED modules in adjacent arrangement;

a first LED module and a second LED module, the first and second LED modules having imaging sides with sets of imaging pixels disposed thereon for generating imaging illumination viewable from an imaging direction, the first and second LED modules coupled with the coupling assembly and situated adjacently to form a seam therebetween, the seam defining a plane between the first LED module and the second LED module, the first LED module having a rearward side, opposite its imaging side, with a set of illuminating pixels disposed thereon;

a set of illuminating pixels situated rearward of the first and second LED modules for generating seam illumination through the seam; and a reflector situated rearward of the first and second LED modules, the reflector extending from one of the first LED module, the second LED module, and the coupling assembly, toward the plane of the seam, to direct the seam illumination through the seam.

2. The LED display system of claim 1, wherein the LED display system further comprises a control unit configured to:

control an imaging property in accordance with a media source, the imaging property comprising at least one of a colour and an intensity of at least one imaging pixel of the sets of imaging pixels; and control an illuminating property in accordance with an illumination scheme, the illuminating property comprising at least one of a colour and an intensity at least one illuminating pixel of the set of illuminating pixels, the illumination scheme comprising controlling the illuminating property in response to at least the imaging property.

3. The LED display system of claim 2, wherein the illumination scheme comprises controlling the intensity of the set of illuminating pixels to cause the seam illumination to match one of an average intensity of the set of imaging pixels of the first LED module, an average intensity of the set of imaging pixels of the second LED module, and an average intensity of the sets of imaging pixels.

4. The LED display system of claim 2, wherein:

the first LED module comprises a rearward side, opposite its imaging side, wherein the set of illuminating pixels is disposed on the rearward side;

the set of illuminating pixels is aligned in pitch with the set of imaging pixels of the first LED module such that each illuminating pixel of the set of illuminating pixels corresponds with a corresponding imaging pixel of the set of imaging pixels of the first LED module; and the illumination scheme comprises tracking at least one of the colour and the intensity of the at least one illuminating pixel of the set of illuminating pixels with its corresponding imaging pixel.

5. The LED display system of claim 1, wherein the rearward side of the first LED module has an edge, and wherein the set of illuminating pixels is disposed along the edge.

6. The LED display system of claim 5, wherein the edge of the rearward side of the first LED module is beveled.

7. The LED display system of claim 1, wherein the rearward side of the first LED module has a perimeter, and wherein the set of illuminating pixels is disposed along the perimeter.

8. The LED display system of claim 1, wherein the reflector comprises a series of concave portions, the series of concave portions aligned in pitch with the set of illuminating pixels.

9. The LED display system of claim 1, wherein at least one of the rearward side of the first LED module and the reflector is treated with an optical coating.

10. The LED display system of claim 1, wherein the reflector is reversibly attachable to the rearward side of the first LED module.

11. The LED display system of claim 1, further comprising:

a first LED tile and a second LED tile coupled by the coupling assembly, wherein the first LED module is situated on the first LED tile and the second LED module is situated on the second LED tile and the seam is formed between the first and second LED tiles.

12. The LED display system of claim 11, wherein:

the first LED module comprises a rearward side, opposite its imaging side, wherein the set of illuminating pixels is disposed on the rearward side;

the seam defines a plane between the first LED module and the second LED module; and the LED display system further comprises a reflector situated rearward of the first and second LED modules, the reflector extending from the coupling assembly, toward the plane of the seam, to direct the seam illumination through the seam.

13. The LED display system of claim 12, wherein the reflector is reversibly attachable to the rearward side of the first LED module.

14. An LED module for use in an LED display system, the LED module comprising:

a set of imaging pixels disposed on a first side for generating imaging illumination;

a set of illuminating pixels disposed adjacent to an edge of a second side, the second side opposite to the first side, for generating seam illumination; and a reflector extending from the second side to direct the seam illumination around the edge.

15. The LED module of claim 14, wherein the reflector comprises a series of concave portions, the series of concave portions aligned in pitch with the set of illuminating pixels.

16. The LED module of claim 14, wherein the edge of the second side is beveled.

17. The LED module of claim 14, wherein at least one of the second side and the reflector is treated with an optical coating.

18. An LED tile for use in an LED display system, the LED tile comprising:

a coupling assembly for securing LED modules, the coupling assembly having an edge adjacent to which at least one LED module is situated, the at least one LED module having an imaging side with a set of imaging pixels for generating imaging illumination disposed thereon, the at least one LED module further having a rearward side, opposite the imaging side, with a set of illuminating pixels for generating seam illumination disposed thereon, wherein the set of imaging pixels and the set of illuminating pixels are controlled by a control unit, the control unit configured to:

control an imaging property in accordance with a media source, the imaging property comprising at least one of a colour and an intensity of at least one imaging pixel of the set of imaging pixels; and control an illuminating property in accordance with an illumination scheme, the illuminating property comprising at least one of a colour and an intensity of at least one illuminating pixel of the set of illuminating pixels, the illumination scheme comprising controlling the illuminating property in response to at least the imaging property; and a reflector extending from the coupling assembly to direct the seam illumination around the edge of the coupling assembly;

wherein the set of illuminating pixels is aligned in pitch with the set of imaging pixels such that each illuminating pixel of the set of illuminating pixels corresponds with a corresponding imaging pixel of the set of imaging pixels, and the illumination scheme comprises tracking at least one of the colour and the intensity of the at least one illuminating pixel of the set of illuminating pixels with its corresponding imaging pixel.

19. The LED tile of claim 18, wherein the reflector comprises a series of concave portions, the series of concave portions aligned in pitch with the set of illuminating pixels.

20. An LED display system comprising:

a coupling assembly for securing LED modules in adjacent arrangement;

a first LED module and a second LED module, the first and second LED modules having imaging sides with sets of imaging pixels disposed thereon for generating imaging illumination viewable from an imaging direction, the first and second LED modules coupled with the coupling assembly and situated adjacently to form a seam therebetween, the first LED module having a rearward side opposite its imaging side;

a set of illuminating pixels disposed on the rearward side of the first LED module for generating seam illumination through the seam, the set of illuminating pixels aligned in pitch with the set of imaging pixels of the first LED module such that each illuminating pixel of the set of illuminating pixels corresponds with a corresponding imaging pixel of the set of imaging pixels of the first LED module; and a control unit configured to:

control an imaging property in accordance with a media source, the imaging property comprising at least one of a colour and an intensity of at least one imaging pixel of the sets of imaging pixels; and control an illuminating property in accordance with an illumination scheme, the illuminating property comprising at least one of a colour and an intensity of at least one illuminating pixel of the set of illuminating pixels, the illumination scheme comprising tracking the illuminating property of the at least one pixel of the set of illuminating pixels with the imaging property of its corresponding imaging pixel.

21. The LED display system of claim 20, wherein the illumination scheme further comprises controlling the intensity of the set of illuminating pixels to cause the seam illumination to match one of an average intensity of the set of imaging pixels of the first LED module, an average intensity of the set of imaging pixels of the second LED module, and an average intensity of the sets of imaging pixels.

22. An LED display system comprising:

a coupling assembly for securing LED modules in adjacent arrangement;

a first LED module and a second LED module, the first and second LED modules having imaging sides with sets of imaging pixels disposed thereon for generating imaging illumination viewable from an imaging direction, the first LED module having a rearward side opposite its imaging side;

a first LED tile and a second LED tile coupled by the coupling assembly, wherein the first LED module is situated on the first LED tile and the second LED module is situated on the second LED tile, the first LED module adjacent to the second LED module across a seam formed between the first LED tile and second LED tile, the seam defining a plane between the first LED module and the second LED module;

a set of illuminating pixels disposed on the rearward side of the first LED module for generating seam illumination through the seam; and a reflector situated rearward of the first and second LED modules, the reflector extending from the coupling assembly, toward the plane of the seam, to direct the seam illumination through the seam.

23. The LED display system of claim 22, wherein the reflector is reversibly attachable to the rearward side of the first LED module.

* * * * *